US010406576B2

(12) United States Patent
Vassena

(10) Patent No.: US 10,406,576 B2
(45) Date of Patent: Sep. 10, 2019

(54) EQUIPMENT FOR COLD-DRAWING A METAL WIRE

(71) Applicant: VASSENA FILIERE S.R.L., Malgrate (LC) (IT)

(72) Inventor: Davide Vassena, Malgrate (IT)

(73) Assignee: VASSENA FILIERE S.R.L., Malgrate (LC) (IT)

( * ) Notice: Subject to any disclaimer, the term of this patent is extended or adjusted under 35 U.S.C. 154(b) by 349 days.

(21) Appl. No.: 15/323,752

(22) PCT Filed: Jul. 15, 2015

(86) PCT No.: PCT/EP2015/066141
§ 371 (c)(1),
(2) Date: Jan. 4, 2017

(87) PCT Pub. No.: WO2016/008915
PCT Pub. Date: Jan. 21, 2016

(65) Prior Publication Data

US 2017/0157657 A1 Jun. 8, 2017

(30) Foreign Application Priority Data

Jul. 16, 2014 (IT) ..... MI2014A1294

(51) Int. Cl.
*B21C 3/14* (2006.01)

(52) U.S. Cl.
CPC ..... *B21C 3/14* (2013.01)

(58) Field of Classification Search
CPC .... B21C 3/00; B21C 3/02; B21C 3/12; B21C 3/14
(Continued)

(56) References Cited

U.S. PATENT DOCUMENTS 2,088,040 A 7/1937 Simons et al.
3,145,832 A * 8/1964 Case ..... B21C 3/14 72/43
(Continued)

FOREIGN PATENT DOCUMENTS

| | | | |
|---|---|---|---|
| EP | 0013012 | A1 | 7/1980 |
| WO | 94/15731 | A1 | 7/1994 |
| WO | 2004/033121 | A1 | 4/2004 |

OTHER PUBLICATIONS

International Search Report, dated Oct. 2, 2015 (3 pages).

*Primary Examiner* — Elaine Gort
*Assistant Examiner* — Christopher B Wehrly
(74) *Attorney, Agent, or Firm* — Jacobson Holman, PLLC.

(57) ABSTRACT

Equipment for cold-drawing a metal wire. The equipment comprises a sequence of a sleeve and a drawing die in the advancing wire path; the sleeve comprises a hole for inserting the wire to be drawn, and the drawing die comprises a conical hole. The equipment comprises first support means of the sleeve and second support means of the drawing die coupled with each other so as to keep the sleeve and the drawing die in place to allow the wire to advance from the sleeve to the drawing die. The first support means comprises a hole for inserting the metal wire which precedes the hole of the sleeve in the metal wire path; the hole of the first support means is coaxial with the hole of the sleeve and has a smaller diameter than the initial opening of the sleeve hole in the metal wire path.

8 Claims, 3 Drawing Sheets

(58) Field of Classification Search
USPC ..... 72/467, 274
See application file for complete search history.

(56) References Cited

U.S. PATENT DOCUMENTS

| | | | | | |
|---|---|---|---|---|---|
| 3,413,832 | A * | 12/1968 | Lang | B21C 3/14 | 72/40 |
| 4,038,858 | A * | 8/1977 | DeZuba | B21C 3/02 | 72/274 |
| 4,211,104 | A * | 7/1980 | Barnabo | B21C 3/04 | 72/467 |
| 5,916,323 | A * | 6/1999 | Bellina | B21C 3/04 | 72/274 |
| 6,430,980 | B1 * | 8/2002 | Weinhold | B21C 3/14 | 72/282 |
| 6,449,997 | B1 * | 9/2002 | Bertolini | B21C 1/04 | 72/278 |
| 2008/0173063 | A1 * | 7/2008 | Tyl | B21C 3/025 | 72/467 |
| 2013/0205861 | A1 * | 8/2013 | Hanada | B21C 1/22 | 72/274 |

* cited by examiner

EQUIPMENT FOR COLD-DRAWING A METAL WIRE

BACKGROUND OF THE INVENTION

The present invention relates to an equipment for cold-drawing a metal wire.

Drawing, i.e., the section decrease of a metal wire or another metal object through drawing dies, is obtained by pulling the material through the drawing die by means of drawing machines.

A commonly used technique, especially for metal wires with a round section, allows a drawing of a metal wire to be obtained by subsequent section decreases due to the passage of the wire in drawing dies placed one after the other and contained, along with a holding tank of the lubricant for the wire, in a single drawing apparatus. The lubrication is obtained by means of the interposition of the lubricant between the metal wire and the drawing die due to both the motion of the wire towards the drawing die and the geometric contour of the drawing die itself.

A piece of equipment for cold-drawing a metal wire is described in patent EP 1554062. The equipment comprises a sequence of a sleeve with cylindrical hole and a drawing die with conical hole. The sleeve is inserted into a support and ends with an extension fitted in said conical hole of the drawing die. The support has a first annular projection and the drawing die has a second annular projection coupled to said first projection so as to keep the sleeve and the drawing die in place.

With said equipment, the operation of assembling the drawing die onto the sleeve becomes very easy; however, problems of adhesion of the lubricant to the wire to be drawn occurred with said equipment, especially at low drawing rates, e.g., in the case of few meters per second.

BRIEF SUMMARY OF THE INVENTION

In view of the described prior art, it is the object of the present invention to provide an equipment for cold-drawing a metal wire which allows an improved adhesion of the lubricant to the wire to be drawn even at low drawing rates.

In accordance with the present invention, such an object is achieved by an equipment for cold-drawing a metal wire, said equipment comprising a sequence of a sleeve and a drawing die in the wire advance path, said sleeve comprising a hole for inserting the wire to be drawn and said drawing die comprising a conical hole, first sleeve support means and second drawing die support means coupled to one another so as to keep said sleeve and said drawing die in place to allow the wire advance path from the sleeve to the drawing die, said first support means comprising a hole for inserting the metal wire, which precedes the hole of the sleeve in the metal wire advance path, said hole of the first support means being coaxial with the hole of the sleeve and having a smaller diameter than the initial opening of the sleeve hole in the metal wire advance path, characterized in that said hole of the sleeve comprises an initial truncated-cone-shaped part, the larger diameter base of which is the initial opening of the sleeve hole in the metal wire advance path, the walls of said initial truncated-con-shaped part of the sleeve hole forming an angle of less than 30° with the hole axis.

BRIEF DESCRIPTION OF THE SEVERAL VIEWS OF THE DRAWING(S)

The features and advantages of the present invention will become apparent from the following detailed description of a practical embodiment thereof, shown by way of a non-limiting example in the accompanying drawings, in which.

DETAILED DESCRIPTION OF THE INVENTION

Figure 1:
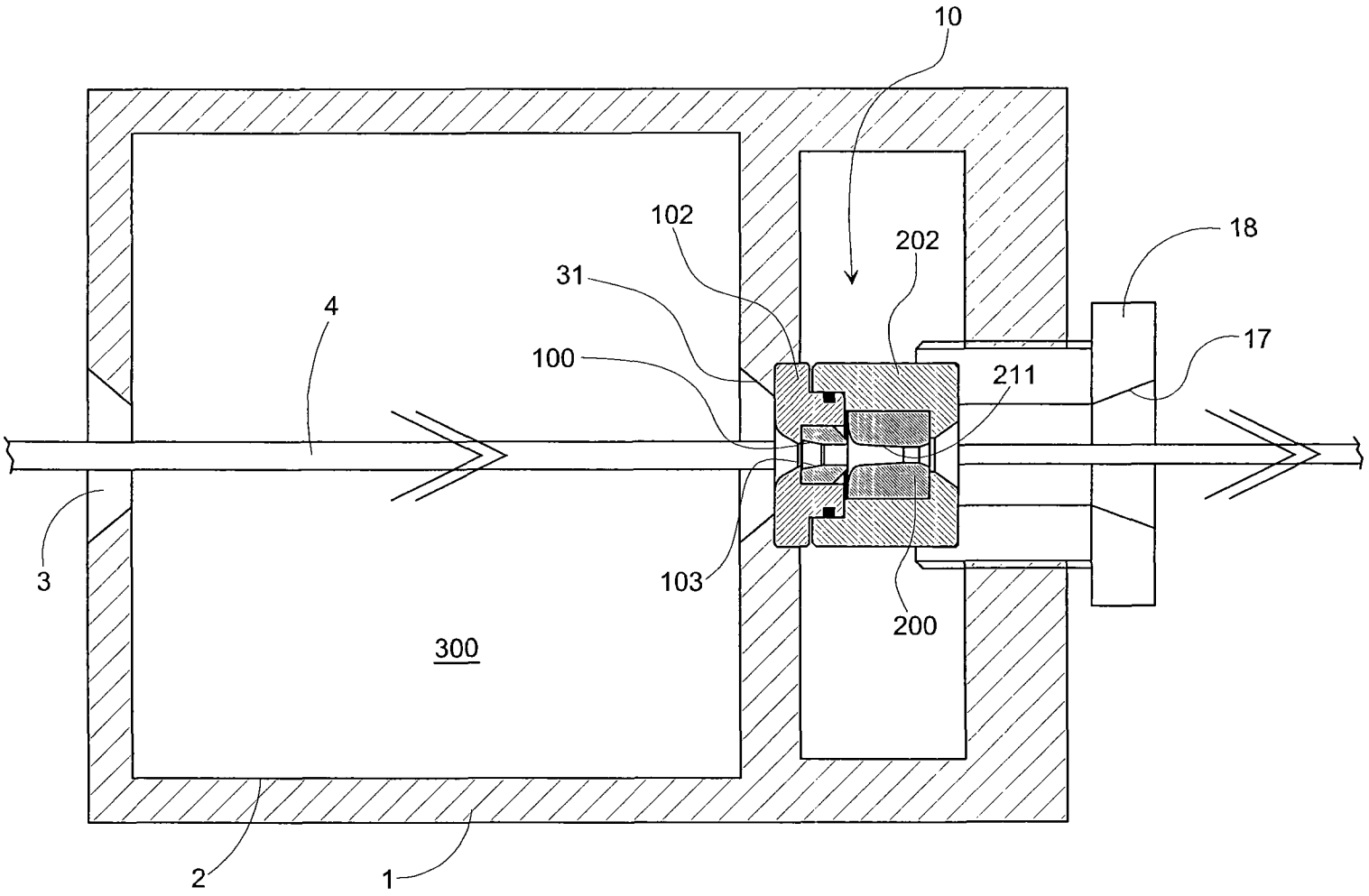
FIG. 1 shows a cross-section of an apparatus for cold-drawing a metal wire comprising the equipment according to the present invention.

With reference to FIG. 1, an apparatus for cold-drawing a metal wire is shown. The apparatus comprises an outer body 1 provided with a tank 2 therein, containing calcium or sodium stearates or another lubricating material 300. Said tank 2 has, at a side end, an inlet hole 3 for the passage of a metal wire 4 (made of steel, copper, aluminum, etc.) to be drawn. The diameter of hole 3 is larger than the cross-section of the metal wire 4.

Tank 2 is provided, at its other side end, with a drawing equipment 10 according to the present invention, which is adapted to draw the metal wire 4; equipment 10 is kept in place on body 1 by a threaded stopper 18 secured to the outer body 1 and crossed by a aperture 17 for wire 4 to exit.

Figure 2:
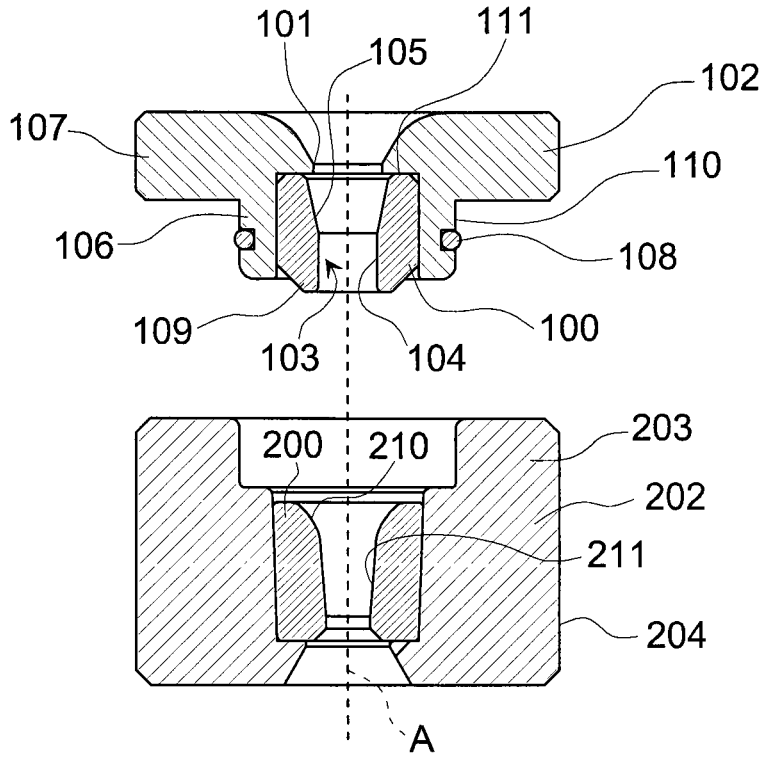
FIG. 2 shows in more detail the equipment in FIG. 1 with the sleeve separated from the drawing die.
Figure 3:
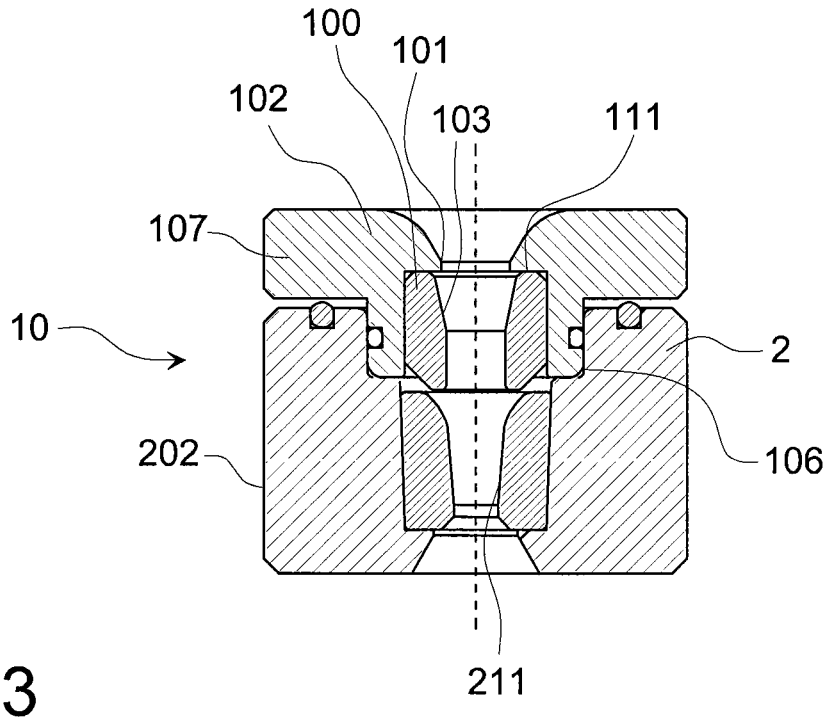
FIG. 3 shows in more detail the equipment in FIG. 1 with the sleeve coupled to the drawing die.

Equipment 10, best shown in FIGS. 2 and 3, comprises, in the advance path of the metal wire 4, a sleeve 100 comprising a body with a circular section, generally made of tungsten carbide, usually referred to as hard metal or Widia, provided with a hole 103 which, in the central part 104 thereof, has a cylindrical shape with a diameter which is slightly larger than that of wire 4 at the inlet, and in the initial part 105 it preferably has a truncated-cone shape with a decreasing diameter to facilitate the insertion of the metal wire 4, as best seen in FIGS. 2 and 3. The smaller diameter opening or base of the initial truncated-cone-shaped part 105 of hole 103 coincides with the section of the cylindrical hole of the central part 104. Sleeve 100 is supported and contained in a casing 102, generally made of steel.

As best seen in FIG. 2, said sleeve 100 has a truncated-cone-shaped extension 109 at an end thereof. Furthermore, said casing 102 has a lower annular part 106 and an upper annular part 107; the upper annular part 107 has a diameter which is larger than the diameter of the lower annular part so as to give casing 102 a stopper shape.

In the advance path of the metal wire 4, after sleeve 100, equipment 10 comprises the drawing die 200 having a body with a circular section, generally made of Widia, comprising a special funnel-shaped inlet cavity 210 and a conical hole which, in the central part 211 thereof, has a truncated-cone shape with a decreasing diameter and the longitudinal symmetry axis A of which coincides with the symmetry axis of the hole 103 of sleeve 100. The drawing die 200 is supported and contained in a casing 202, generally made of steel, having an upper annular projection 203 on the outer cylindrical blanket 204.

The drawing die 200 is kept in place, thus similarly positioning sleeve 100 by means of the coupling between the upper annular projection 203 of the casing 202 of the drawing die 200 and the lower annular projection 106 of the casing 102 of sleeve 100. This is obtained by manually assembling and pressing casing 102 onto casing 202; for this reason, the casings 102 and 202 do not need to be threaded.

An annular gasket 108 is also included on the part 110 of the lower annular projection 106, which abuts against the annular projection 203 of the casing 202 of the drawing die 200 when sleeve 100 is coupled to the drawing die 200.

During the drawing operation occurring in the described structure, the metal wire 4 passing through tank 2 draws the lubricant 300 contained therein. Thereafter, wire 4 passes through sleeve 100 without any decrease in diameter and through the drawing die 200 having a truncated-cone-shaped hole, where the drawing is carried out. The lubricant reaches sleeve 100 along with wire 4, where the suitable pressure and lubricating properties are maintained for the proper lubrication of the wire 4 which is drawn.

Figure 4:
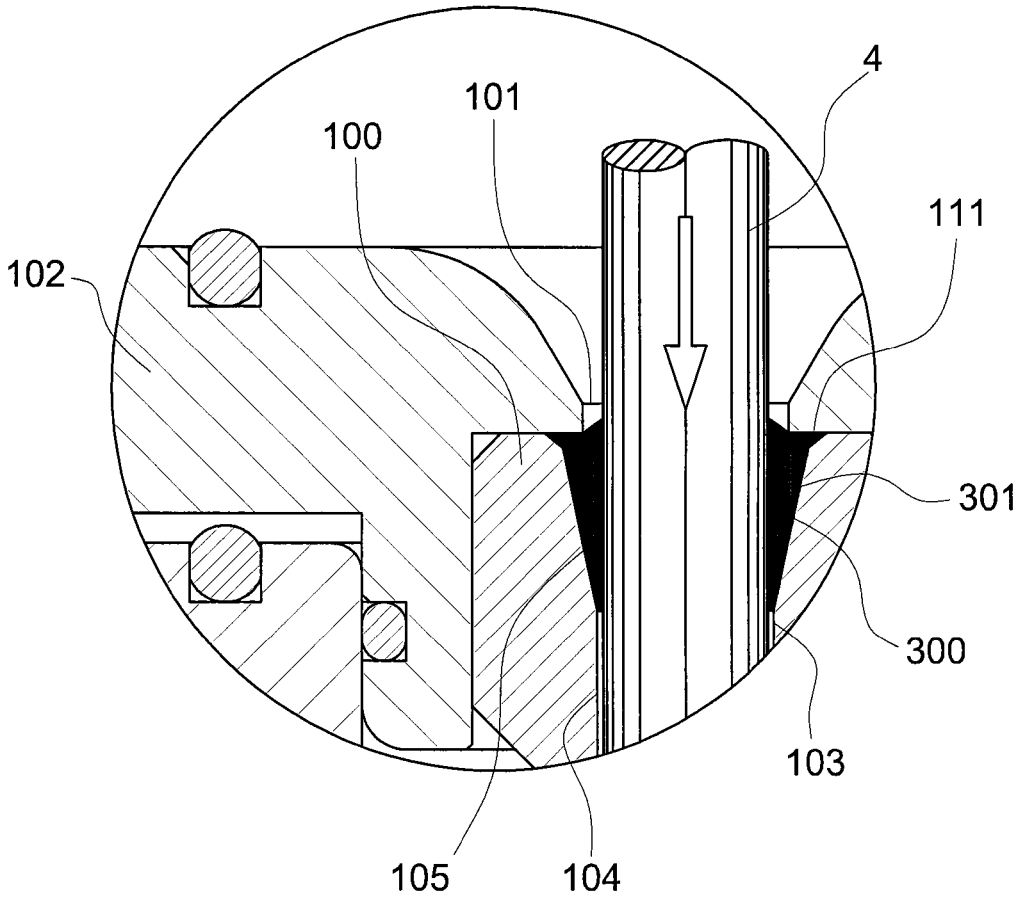
FIG. 4 shows in detail a part of the sleeve with its support member.

In the advance path of the metal wire 4, casing 102 comprises a hole 101, preferably circular in shape, for inserting the metal wire, which precedes the sleeve hole 103 in the advance path of the metal wire 4, as best shown in FIG. 4. The hole 101 of casing 102 is coaxial with the sleeve hole 103 and has a smaller diameter than the initial opening 111 of the sleeve hole in the advance path of the metal wire. Thereby, a space 301 for collecting the lubricant 300 between the side wall of hole 103, the metal wire 4 and the casing 102 is obtained.

Hole 101 is arranged so as to form a space 301 for collecting the lubricant 300 between the side wall of hole 103, the metal wire 4 and the casing 102. Hole 101 is preferably adjacent to the sleeve hole 103, and space 301 is arranged between the side wall of hole 103, the metal wire 4, the wall of casing 102 so as to be substantially perpendicular to the axis A of the holes 101, 103.

The initial opening 111 preferably coincides with the major base of the initial truncated-cone-shaped part 105 of hole 103. The lubricant 300 drawn by the metal wire 4 does not return to tank 2 but remains inside space 301 between the truncated-cone-shaped part 105 of hole 103 and the metal wire 4. Thereby, the efficiency of the operation of cold-drawing the metal wire is improved even at low drawing rates.

The difference between the circular hole 101 and the initial opening 111 is preferably of about 0.5 mm.

The walls of the truncated-cone-shaped part 105 of hole 103 preferably form an angle of less than 30° with axis A; in fact, with angles of more than 30°, the lubricant 300 is not able to flow into the sleeve, and the lubricant returns to tank 2.

The walls of the truncated-cone-shaped part 105 of hole 103 preferably form an angle of more than 20° with axis A; in fact, with angles of less than 20°, there is not a pressure effect of lubricant 300 onto the metal wire 4, which allows the operation of cold-drawing the metal wire to be improved. The presence of the so-designed space 301 allows a more compact lubricant pad having a larger pressure to be created in the drawing die; for this reason, the molecules of the metal wire 4 suffer from less stress during the step of drawing, since the friction coefficient is decreased from 0.05 to 0.005.

The walls of the truncated-cone-shaped part 105 of hole 103 preferably form an angle of 24° with axis A in order to optimize the lubrication of the metal wire 4.

The inlet hole 101 for the metal wire 4 preferably has a smaller diameter than the initial opening 111 only in the circular part of hole 101 adjacent to the initial part 105 of hole 103.

The diameter of the hole 101 of the casing 102 preferably coincides with the diameter of the cylindrical part 104 of the sleeve hole; thereby, the lubrication of the metal wire 4 is increased.

The presence of space 301 allows an efficient cold-drawing of the metal wire 4 to be carried out both at high rates, typically 40 m/s, and at low rates, typically 1 m/s. In fact, the lubrication of the metal wire 4 which is obtained at 1 m/s drawing rate is considerably higher than that obtained at the same drawing rate by means of known equipment. Moreover, the presence of space 301 allows the vibration effect occurring when drawing a high-carbon metal wire 4 at rates of more than of 20 m/s to be eliminated.

Furthermore, the equipment according to the present invention allows a high pressure lubricant 300 to be used (for example, at 200 atm); this improves the efficiency of the operation of drawing the metal wire. By improving the lubrication of the metal wire 4, the lifetime of equipment 10 is increased, preferably by 80%, compared to known equipment.

The invention claimed is:

1. Equipment for cold-drawing a metal wire, said equipment comprising a sequence of a sleeve and a drawing die in a mental wire advancing path, said sleeve comprising a hole for inserting the wire to be drawn and said drawing die comprising a conical hole, first sleeve support means and second drawing die support means coupled to one another so as to keep said sleeve and said drawing die in place to allow the wire to advance from the sleeve to the drawing die, said first sleeve support means comprising a hole for inserting the metal wire which precedes the sleeve hole in the metal wire advancing path, said hole of the first sleeve support means being coaxial with the sleeve hole and having a smaller diameter than the initial opening of the sleeve hole in the metal wire advancing path, wherein said hole of the sleeve comprises an initial truncated-cone-shaped part, the larger diameter base of which is the initial opening of the sleeve hole in the metal wire advancing path, the walls of said initial truncated-cone-shaped part of the sleeve hole forming an angle of less than 30° with the hole axis; wherein the walls of said initial truncated-cone-shaped part of the sleeve hole form an angle of more than 20° with the hole axis.

2. The equipment according to claim 1, wherein said hole of the sleeve comprises a cylindrical part having a diameter which coincides with the diameter of the smaller diameter base of the initial truncated-cone-shaped part.

3. The equipment according to claim 2, wherein the diameter of the hole of the first sleeve support means coincides with the diameter of the cylindrical part of the sleeve hole.

4. The equipment according to claim 1, wherein the difference between the diameters of the hole of the first sleeve support means and the initial opening of the sleeve hole is about 1 mm.

5. The equipment according to claim 1, wherein said first sleeve support means and said second drawing die support means are press-coupled together by means of manual assembling.

6. The equipment according to claim 1, wherein said hole of the first sleeve support means is arranged so as to form a space for collecting a lubricant between the walls of said initial truncated-cone-shaped part of the sleeve hole, the first sleeve support means and the metal wire.

7. The equipment according to claim 1, wherein said hole of the first sleeve support means is adjacent to the sleeve hole.

8. An apparatus for cold-drawing a metal wire, said apparatus comprising a wire lubrication tank and drawing equipment arranged at the outlet of said tank, said drawing equipment being defined as in claim 1.

* * * * *